US007841394B2

(12) United States Patent
McNeel et al.

(10) Patent No.: US 7,841,394 B2
(45) Date of Patent: Nov. 30, 2010

(54) METHOD AND APPARATUS FOR CENTRALIZED WELL TREATMENT

(75) Inventors: William Lloyd McNeel, Green River, WY (US); Steve Harris, Palisade, CO (US); Dave McLeod, Houston, TX (US)

(73) Assignee: Halliburton Energy Services Inc., Duncan, OK (US)

( * ) Notice: Subject to any disclaimer, the term of this patent is extended or adjusted under 35 U.S.C. 154(b) by 0 days.

(21) Appl. No.: 11/291,496

(22) Filed: Dec. 1, 2005

(65) Prior Publication Data

US 2007/0125543 A1 Jun. 7, 2007

(51) Int. Cl.
*E21B 19/00* (2006.01)
*E21B 43/26* (2006.01)

(52) U.S. Cl. ..... 166/90.1; 166/308.1; 166/305.1

(58) Field of Classification Search ..... 166/90.1; 137/562.29, 572, 597, 861, 897
See application file for complete search history.

(56) References Cited

U.S. PATENT DOCUMENTS

| | | | | |
|---|---|---|---|---|
| 2,758,653 | A | 8/1956 | Desbrow | |
| 2,953,460 | A | 9/1960 | Baker | |
| 2,980,291 | A | 4/1961 | Schuerger | |
| 3,062,286 | A | 11/1962 | Wyllie | |
| 3,455,391 | A | 7/1969 | Matthews | |
| 3,537,529 | A | 11/1970 | Timmerman | |
| 3,556,218 | A | 1/1971 | Talley | |
| 3,578,080 | A | 5/1971 | Closmann | |
| 3,682,246 | A | 8/1972 | Closmann | |
| 3,822,747 | A | 7/1974 | Maguire | |
| 3,933,205 | A | 1/1976 | Kiel | |
| 4,050,529 | A | 9/1977 | Tagirov et al. | |
| 4,077,428 | A * | 3/1978 | Weaver | 137/565.3 |

(Continued)

FOREIGN PATENT DOCUMENTS

EP 0124251 11/1984

(Continued)

OTHER PUBLICATIONS

Information Disclosure Statement, p. 1. Jobs performed by Halliburton and other companies at Bakersfield, California in the late 1980s.

(Continued)

*Primary Examiner*—Zakiya W Bates
*Assistant Examiner*—Angela M Ditrani
(74) *Attorney, Agent, or Firm*—John W. Wustenberg; McDermott, Will & Emery

(57) ABSTRACT

A method of communicating between a central location and multiple well locations is disclosed that includes the steps of stimulating a first well from the central location using a first stimulation fluid through a first fluid line; and simultaneously stimulating a second well from the central location using a second stimulation fluid through a second fluid line. An apparatus for centralized well operations is disclosed that includes a well treatment operations factory which manufactures and pumps a well stimulation fluid; a first connection between a first well location and the well operations factory; a second connection between a second well location and the well operations factory; and means for simultaneously flowing a first stimulation fluid to the first well location and a second stimulation fluid to a second well location. Manifolds for centralized well stimulation are disclosed.

27 Claims, 7 Drawing Sheets

U.S. PATENT DOCUMENTS

| | | | | |
|---|---|---|---|---|
| 4,137,970 | A | 2/1979 | Laflin et al. | |
| 4,209,278 | A | 6/1980 | Cooper et al. | |
| 4,265,266 | A * | 5/1981 | Kierbow et al. | 137/101.19 |
| 4,305,463 | A * | 12/1981 | Zakiewicz | 166/245 |
| 4,353,482 | A | 10/1982 | Tomlinson et al. | |
| 4,409,927 | A | 10/1983 | Loesch et al. | |
| 4,410,106 | A | 10/1983 | Kierbow et al. | |
| 4,427,133 | A | 1/1984 | Kierbow et al. | |
| 4,512,187 | A * | 4/1985 | Sigwardt | 73/198 |
| 4,635,723 | A | 1/1987 | Spivey | |
| 4,701,095 | A | 10/1987 | Berryman et al. | |
| 4,715,721 | A * | 12/1987 | Walker et al. | 366/132 |
| 4,716,932 | A * | 1/1988 | Adams, Jr. | 137/565.29 |
| 4,724,905 | A | 2/1988 | Uhri | |
| 4,733,567 | A | 3/1988 | Serata | |
| 4,830,106 | A | 5/1989 | Uhri | |
| 4,845,981 | A | 7/1989 | Pearson | |
| 4,850,750 | A | 7/1989 | Cogbill et al. | |
| 4,974,675 | A | 12/1990 | Austin et al. | |
| 5,014,218 | A | 5/1991 | Crain et al. | |
| 5,111,881 | A | 5/1992 | Soliman et al. | |
| 5,228,510 | A | 7/1993 | Jennings, Jr. | |
| 5,245,548 | A | 9/1993 | Kuan | |
| 5,281,023 | A | 1/1994 | Cedillo et al. | 366/17 |
| 5,365,435 | A | 11/1994 | Stephenson | 700/265 |
| 5,417,283 | A | 5/1995 | Ejiogu et al. | |
| 5,494,103 | A | 2/1996 | Surjaatmadja et al. | |
| 5,499,678 | A | 3/1996 | Surjaatmadja et al. | |
| 5,515,920 | A * | 5/1996 | Luk et al. | 166/280.1 |
| 5,574,218 | A | 11/1996 | Withers | |
| 5,659,480 | A | 8/1997 | Anderson et al. | |
| 6,120,175 | A | 9/2000 | Tewell | |
| 6,193,402 | B1 | 2/2001 | Grimland et al. | |
| 6,236,894 | B1 | 5/2001 | Stoisits et al. | |
| 6,394,184 | B2 | 5/2002 | Tolman et al. | 166/281 |
| 6,575,247 | B2 | 6/2003 | Tolman et al. | |
| 6,644,844 | B2 * | 11/2003 | Neal et al. | 366/10 |
| 6,729,394 | B1 * | 5/2004 | Hassan et al. | 166/245 |
| 6,935,424 | B2 | 8/2005 | Lehman | |
| 6,991,037 | B2 | 1/2006 | Hocking | |
| 7,036,587 | B2 | 5/2006 | Munoz, Jr. et al. | |
| 7,143,832 | B2 | 12/2006 | Freyer | |
| 7,225,869 | B2 | 6/2007 | Willett et al. | |
| 7,243,726 | B2 | 7/2007 | Ohmer | |
| 7,367,411 | B2 | 5/2008 | Leuchtenberg | |
| 7,391,675 | B2 | 6/2008 | Drew | |
| 7,431,090 | B2 | 10/2008 | Surjaatmadja et al. | |
| 7,445,045 | B2 | 11/2008 | East, Jr. et al. | |
| 7,711,487 | B2 | 5/2010 | Surjaatmadja | |
| 2002/0125011 | A1 | 9/2002 | Snider et al. | |
| 2003/0050758 | A1 | 3/2003 | Soliman et al. | |
| 2003/0141064 | A1 | 7/2003 | Roberson, Jr. | |
| 2004/0020662 | A1 | 2/2004 | Freyer | 166/387 |
| 2005/0121196 | A1 | 6/2005 | East, Jr. et al. | |
| 2005/0211439 | A1 | 9/2005 | Willett et al. | |
| 2006/0081412 | A1 | 4/2006 | Wright et al. | |
| 2006/0161358 | A1 | 7/2006 | Dykstra et al. | |
| 2006/0185848 | A1 | 8/2006 | Surjaatmadja et al. | |
| 2006/0243437 | A1 * | 11/2006 | Albers et al. | 166/250.01 |
| 2006/0289167 | A1 | 12/2006 | Surjaatmadja et al. | |
| 2007/0116546 | A1 | 5/2007 | Dearing | |
| 2007/0125543 | A1 | 6/2007 | McNeel et al. | 166/308.3 |
| 2007/0125544 | A1 | 6/2007 | Robinson et al. | 166/308.3 |
| 2007/0153622 | A1 | 7/2007 | Dykstra et al. | |
| 2007/0153623 | A1 | 7/2007 | Dykstra et al. | |
| 2007/0153624 | A1 | 7/2007 | Dykstra et al. | |
| 2007/0171765 | A1 | 7/2007 | Dykstra et al. | |
| 2007/0201305 | A1 | 8/2007 | Heilman et al. | |
| 2008/0083531 | A1 | 4/2008 | Surjaatmadja | |
| 2008/0083532 | A1 | 4/2008 | Surjaatmadja | 166/250.1 |
| 2008/0083538 | A1 | 4/2008 | Soliman | |
| 2008/0236818 | A1 | 10/2008 | Dykstra | |
| 2009/0050311 | A1 | 2/2009 | Crawford | |
| 2009/0194273 | A1 | 8/2009 | Surjaatmadja | |

FOREIGN PATENT DOCUMENTS

| | | | |
|---|---|---|---|
| EP | 0474350 | | 3/1992 |
| EP | 0508817 | | 10/1992 |
| GB | 1460647 | A | 1/1977 |
| NO | 20042134 | | 11/2005 |
| WO | WO 2004/007894 | | 1/2004 |
| WO | WO 2007/024383 | A2 | 7/2006 |
| WO | WO 2006/109035 | A | 10/2006 |
| WO | PCT/US2006/028608 | | 3/2007 |
| WO | WO 2007/024383 | * | 3/2007 |
| WO | WO2008/041010 | A1 | 4/2008 |
| WO | WO2008/142406 | A3 | 11/2008 |

OTHER PUBLICATIONS

Information Disclosure Statement, p. 2. Jobs performed by Halliburton and other companies at Bakerfield, California in 1994.
Information Disclosure Statement, p. 2. Jobs performed by Halliburton at Bakersfield, California in 1994.
Information Disclosure Statement, p. 2. Jobs performed by Schlumberger at Bakerfield, California in 1994.
Information Disclosure Statement, p. 2. Jobs performed by Schlumberger at Lost Hills in 1996.
Information Disclosure Statement, p. 2. Jobs performed by BJ Services in 2004.
Information Disclosure Statement, p. 2-3. Jobs performed by Halliburton in Rock Springs, Wyoming in Mar. 2005.
Notice of Publication dated Apr. 10, 2008 from U.S. Appl. No. 11/753,314.
Office Action from U.S. Appl. No. 11/396,918, May 3, 2007.
Foreign communication related to a counter part application, Jun. 11, 2007.
Foreign communication related to a counter part application, Sep. 5, 2007.
Final Rejection of U.S. Appl. No. 11/396,918, Jan. 25, 2008.
Warpinski, Nonnan R and Branagan, Paul T., "Altered Stress Fracturing", JPT, 990-97, 473-476, Sep. 1989.
Surjaatmadja, "Single Point of Initiation, Dual-Fracture Placement for Maximizing Well Production," 2007 Society of Petroleum Engineers, SPE 107718.
Surjaatmadja, "The Important Second Fracture and its Operational Placement for Maximizing Production," Society of Petroleum Engineers SPE 107059.
Surjaatmadja, "The Mythical Second Fracture and its Operational Placment for Maximizing Production," Society of Petroleum Engineers SPE 106046.
U.S. Appl. No. 11/545,749, filed Oct. 10, 2006, Surjaatmadja.
U.S. Appl. No. 11/753,314, filed May 24, 2007, Surjaatmadja.
Office Action for U.S. Appl. No. 11/363,559 mailed Jan. 23, 2009.
Office Action for U.S. Appl. No. 11/545,749, mailed Feb. 10, 2009.
Information Disclosure Statement for U.S. Appl. No. 11/396,918, Oct. 15, 2007.
Information Disclosure Statement for U.S. Appl. No. 11/873,160, Oct. 16, 2007.
Information Disclosure Statement for U.S. Appl. No. 11/873,186, Oct. 16, 2007.
Office Action for U.S. Appl. No. 11/753,314, Jun. 12, 2008.
International Search Report for International Application No. PCT/GB2008/001044, Aug. 13, 2008.
Office Action for U.S. Appl. No. 11/873,186, Sep. 24, 2008.
Notice of Publication for U.S. Appl. No. 11/691,623, Oct. 2, 2008.
Office Action for U.S. Appl. No. 11/753,314 dated Nov. 19, 2008.
Office Action for U.S. Appl. No. 11/396,918 dated Oct. 15, 2008.
Office Action for U.S. Appl. No. 11/873,186, dated Mar. 23, 2009.
Surjaatmadja et al., "Consideration for Future Stimulation Options is Vital in Deciding Horizontal Well Drilling and Completion Schemes for Production Optimization," Society of Petroleum Engineers, 2006, SPE 103774.
Office Action for U.S. Appl. No. 11/545,749 dated Jan. 27, 2010.

Office Action for U.S. Appl. No. 11/873,186 dated Jan. 25, 2010.
Notice of Allowance and Notice of Allowability for U.S. Appl. No. 11/753,314 dated Dec. 17, 2009.
Notice of Allowance for U.S. Appl. No. 11/753,314, dated Dec. 17, 2009.
Office Action for U.S. Appl. No. 11/396,918, dated Dec. 1, 2009.
Office Action for U.S. Appl. No. 11/545,749, dated Jan. 27, 2010.
Office Action for U.S. Appl. No. 11/873,186, dated Jan. 25, 2010.
Notice of Allowance for U.S. Appl. No. 11/691,623 dated Feb. 18, 2010.
Notice of Allowance for U.S. Appl. No. 11/545,749 dated Apr. 5, 2010.
Office Action for U.S. Appl. No. 11/396,918, dated Apr. 29, 2009.
Office Action for U.S. Appl. No. 11/545,749, dated May 1, 2009.
Office Action for U.S. Appl. No. 11/753,314, dated May 5, 2009.
Office Action for U.S. Appl. No. 11/691,623, dated Jul. 9, 2009.
Office Action for U.S. Appl. No. 11/873,186, dated Oct. 5, 2009.
Office Action for U.S. Appl. No. 11/873,160, dated Oct. 1, 2009.
International Preliminary Report on Patentability from PCT/GB2008/001044, dated Oct. 8, 2009.
Office Action from U.S. Appl. No. 11/873,160 dated May 24, 2010.
International Search Report for International Application No. PCT/GB2007/000677 Jun. 11, 2007.
Office Action for U.S. Appl. No. 11/396,918 dated Jan. 25, 2008.
Search Report and Written Opinion for International Application No. PCT/ GB2008/001730 dated May 21, 2008.
Notice of Allowance for U.S. Appl. No. 11/691,623 dated Jul. 26, 2010.

* cited by examiner

METHOD AND APPARATUS FOR CENTRALIZED WELL TREATMENT

FIELD OF THE INVENTION

The present invention relates generally to well operations, and more particularly to methods and apparatuses for simultaneously treating multiple wells from a centralized location and simultaneously connecting multiple wells to a single manifold, so as to conserve labor, infrastructure, and environmental impact.

BACKGROUND

In the production of oil and gas in the field, it is often required to stimulate and treat several well locations within a designated amount of time. Stimulation and treatment processes often involve mobile equipment that is set up and put in place at a pad and then moved by truck from pad to pad within short time periods. Only during non-stimulation activities, such as water flood operations, can some operations occur simultaneously.

This movement of equipment and personnel can involve complex logistics. The servicing and stimulation of wells can require a series of coordinated operations that begin with the supply by truck of equipment, supplies, fuel, and chemicals to the wellhead. The equipment is then set up and made ready with proppant and chemicals. After completion of the well services, equipment must be broken down and made ready for transport to the next pad for service. Often, the next pad will be less than 500 feet away from the previously treated pad. In addition, due to the limited storage capacity of the moving equipment for chemicals and equipment, additional trucks are often required to resupply and reequip an existing operation. This movement of equipment and supplies has environmental impacts, and the exposure of mobile equipment to adverse weather conditions can jeopardize well treatment operations and worker safety.

SUMMARY

In general, one aspect of the invention features a method of stimulating multiple wells from a central location. The method includes the steps of stimulating a first well from the central location using a first stimulation fluid through a first fluid line; and simultaneously stimulating a second well from the central location using a second stimulation fluid through a second fluid line. The fluid can be any combination of proppant, fracturing fluid, gelling agent, friction reducer, and acid. The first fluid and the second fluid may have the same composition.

Another aspect of the invention features a method of stimulating multiple wells. The method includes the steps of stimulating a first well location through a first stimulation fluid from a central manifold; and simultaneously stimulating a second well location through a second stimulation fluid from the central manifold. The fluid can be any combination of proppant, fracturing fluid, gelling agent, friction reducer, and acid. The first fluid and the second fluid may have the same composition.

Another aspect of the invention features an apparatus for centralized well operations. The apparatus includes a well operations factory which manufactures and pumps a well treatment fluid, a first connection between a first well location and the factory, and a second connection between a second well location and the factory. The well treatment operations factory comprises a means for simultaneously flowing a first stimulation fluid to the first well location via the first connection and a second stimulation fluid to the second well location via the second connection. The fluid can be any combination of proppant, fracturing fluid, gelling agent, friction reducer, and acid. The first fluid and the second fluid may have the same composition. The means for simultaneously flowing can be a manifold. The well treatment operations factory can include a power unit, a proppant storage system, chemical storage system, a pumping grid, and a blending unit. It can be enclosed in a supported fabric structure, a collapsible structure, a prefabricated structure, a retractable structure, a composite structure, a temporary structure, a prefabricated wall and roof structure, a deployable structure, a modular structure, a preformed structure, a mobile accommodation structure, and combinations thereof. The first connection is operable to deliver a fluid from the first well location to the manifold. This fluid can be a stimulation fluid, a drilling fluid, or a production fluid. The second connection is operable to deliver a fluid from the second well location to the manifold. This fluid can be a production fluid or a stimulation fluid. The manifold can be connected to a second manifold. The second manifold is operable to connect to multiple wells simultaneously. The apparatus can include a third connection between the manifold and the first well location. The third connection is operable to deliver a fluid from the first well location to the manifold. This fluid can be a production fluid or a stimulation fluid. The apparatus can include a fourth connection between the manifold and the second well location. The fourth connection is operable to deliver a fluid from the second well location to the manifold. This fluid can be a production fluid or a stimulation fluid.

Another aspect of the invention features an apparatus for directing stimulation fluid that includes a first input for accepting pressurized stimulation fluid; a first line connected to the first input, the first line including: a first valve connected to a first pressure sensor, the first pressure sensor further connected to a second valve; the first line connected to a first wellhead; a second line connected to the first input, the second line including a third valve connected to a second pressure sensor, the second pressure sensor further connected to a fourth valve; the second line connected to a second wellhead.

Another aspect of the invention features an apparatus for directing stimulation fluid that includes a first input for accepting a first pressurized stimulation fluid; a second input for accepting a second pressurized stimulation fluid; a first line connected to the first input, the first line comprising a first valve; a second line connected to the second input, the second line comprising a second valve; the first line and the second line connected together at a first junction, the first junction further connected to a first wellhead; a third line connected to the first input, the third line comprising a third valve; a fourth line connected to the second input, the fourth line comprising a fourth valve; and the third line and the fourth line connected together at a second junction, the second junction further connected to a second wellhead. Each line can further include a pressure sensor and an additional valve.

BRIEF DESCRIPTION OF THE DRAWINGS

A more complete understanding of the present disclosure and advantages thereof may be acquired by referring to the following description taken in conjunction with the accompanying drawings. The drawings illustrate only exemplary embodiments and are not intended to be limiting against the invention.

DETAILED DESCRIPTION

The details of the methods and apparatuses according to the present invention will now be described with reference to the accompanying drawings.

Figure 1:
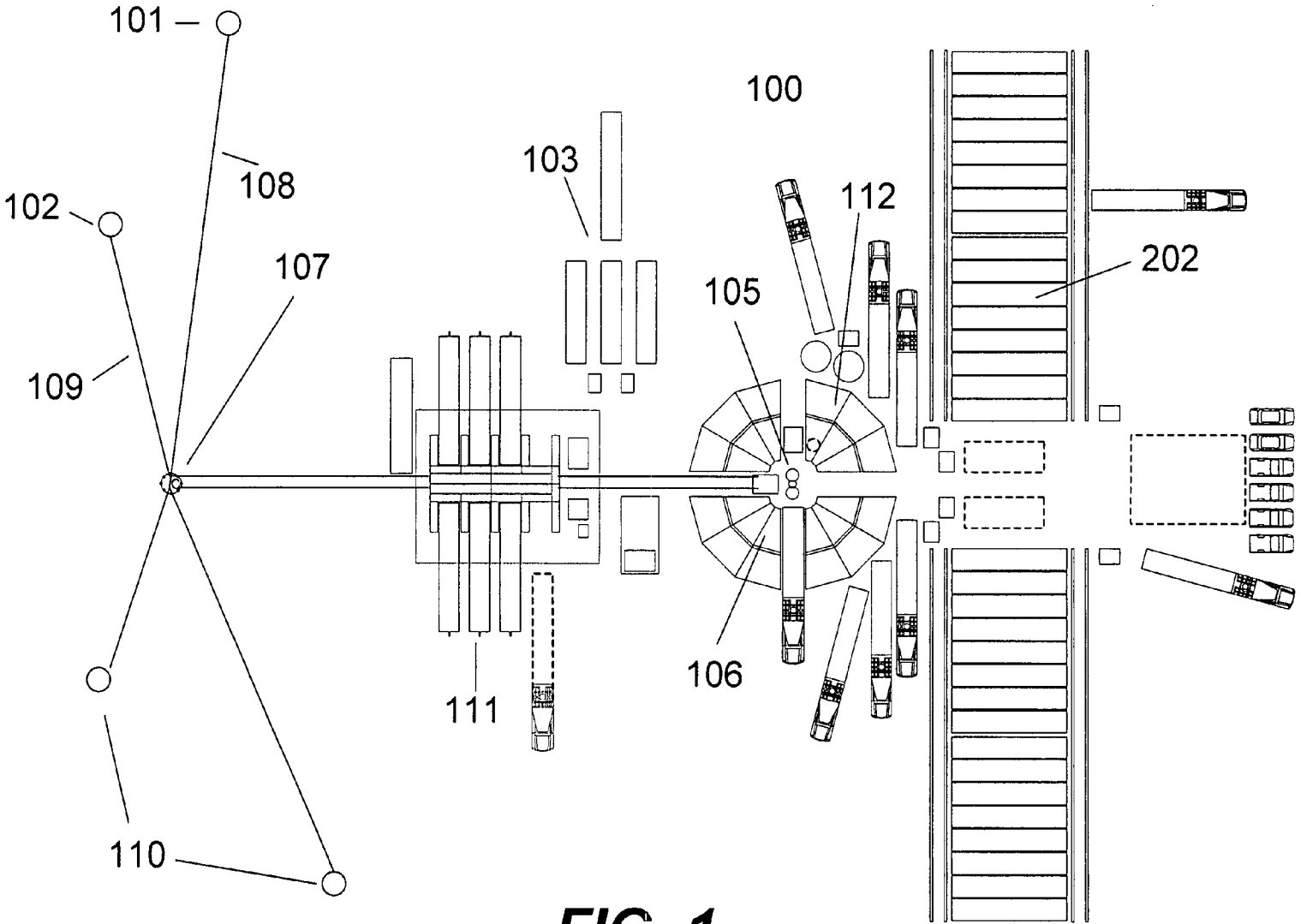
FIG. 1 is a diagram of a centralized well treatment facility.

In reference to FIG. 1, in one embodiment, a well treatment operations factory 100 includes one or more of the following: a centralized power unit 103; a pumping grid 111; a central manifold 107; a proppant storage system 106; a chemical storage system 112; and a blending unit 105. In this and other embodiments, the well treatment factory may be set upon a pad from which many other wellheads on other pads 110 may be serviced. The well treatment operations factory may be connected via the central manifold 107 to at least a first pad 101 containing one or more wellheads via a first connection 108 and at least a second pad 102 containing one or more wellheads via a second connection 109. The connection may be a standard piping or tubing known to one of ordinary skill in the art. The factory may be open, or it may be enclosed at its location in various combinations of structures including a supported fabric structure, a collapsible structure, a prefabricated structure, a retractable structure, a composite structure, a temporary building, a prefabricated wall and roof unit, a deployable structure, a modular structure, a preformed structure, or a mobile accommodation unit.

In one embodiment of the centralized power unit 103, the unit provides electrical power to all of the subunits within the well operations factory 100 via electrical connections. The centralized power unit 103 can be powered by liquid fuel, natural gas or other equivalent fuel and may optionally be a cogeneration power unit. The unit may comprise a single trailer with subunits, each subunit with the ability to operate independently. The unit may also be operable to extend power to one or more outlying wellheads.

In one embodiment, the proppant storage system 106 is connected to the blending unit 105 and includes automatic valves and a set of tanks that contain proppant. Each tank can be monitored for level, material weight, and the rate at which proppant is being consumed. This information can be transmitted to a controller or control area. Each tank is capable of being filled pneumatically and can be emptied through a calibrated discharge shoot by gravity. Tanks may be added to or removed from the storage system as needed. Empty storage tanks may be in the process of being filled by proppant at the same time full or partially full tanks are being used, allowing for continuous operation. The tanks can be arranged around a calibrated v-belt conveyor. In addition, a resin-coated proppant may be used by the addition of a mechanical proppant coating system. The coating system may be a Muller System.

In one embodiment, the chemical storage system 112 is connected to the blending unit and can include tanks for breakers, gel additives, crosslinkers, and liquid gel concentrate. The tanks can have level control systems such as a wireless hydrostatic pressure system and may be insulated and heated. Pressurized tanks may be used to provide positive pressure displacement to move chemicals, and some tanks may be agitated and circulated. The chemical storage system can continuously meter chemicals through the use of additive pumps which are able to meter chemical solutions to the blending unit 105 at specified rates as determined by the required final concentrations and the pump rates of the main treatment fluid from the blending unit. Chemical storage tanks are pressurized to drive fluid flow. The quantities and rates of chemicals added to the main fluid stream are controlled by valve-metering control systems. In addition, chemical additives could be added to the main treatment fluid via aspiration (Venturi Effect). The rates that the chemical additives are aspirated into the main fluid stream can be controlled via adjustable, calibrated apertures located between the chemical storage tank and the main fluid stream. In the case of fracturing operations, the main fluid stream may be either the main fracture fluid being pumped or may be a slip stream off of a main fracture fluid stream. In one embodiment, the components of the chemical storage system are modularized allowing pumps, tanks, or blenders to be added or removed independently.

Figure 2:
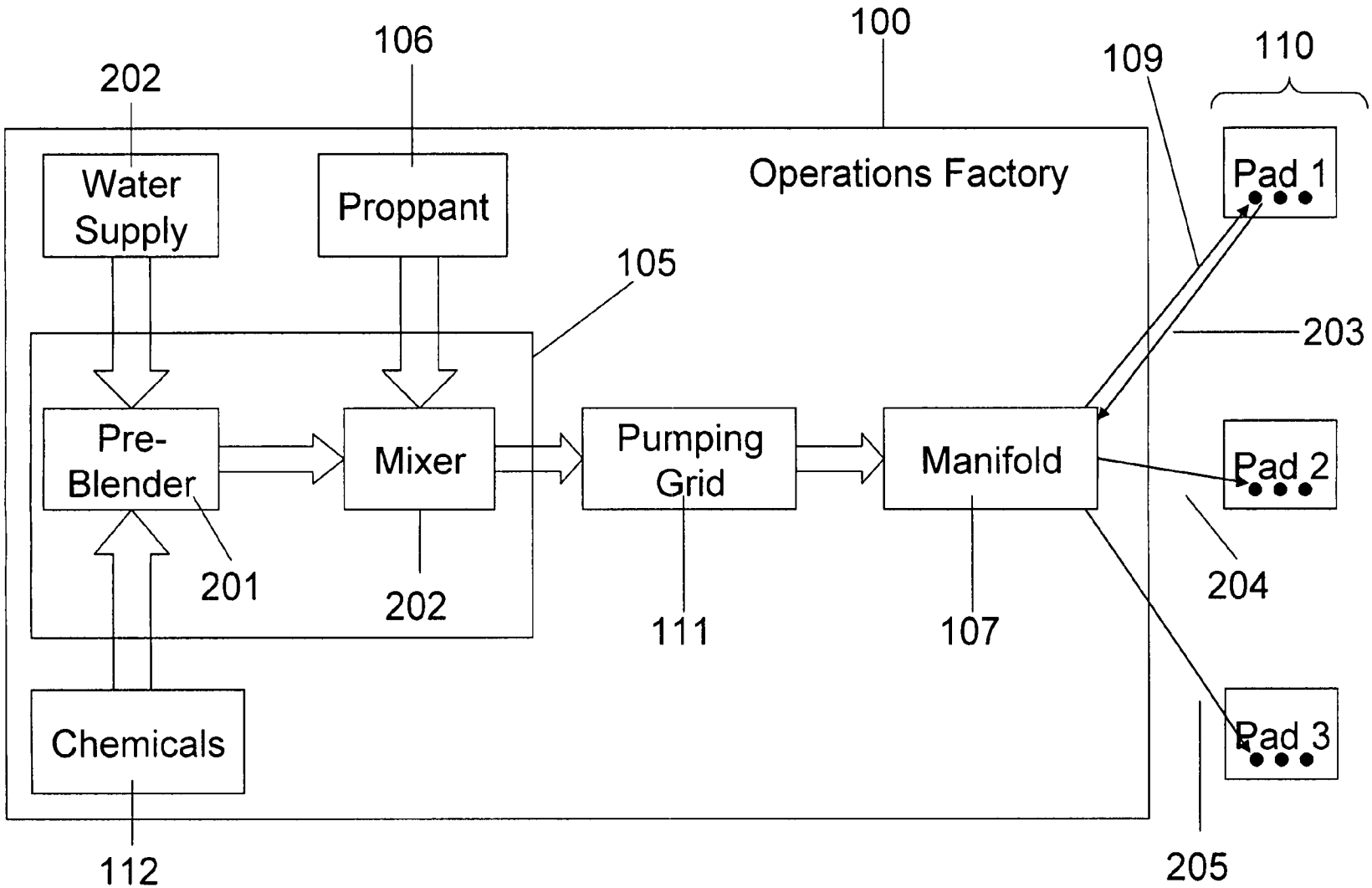
FIG. 2 is a flow diagram of a centralized well treatment facility.

In reference to FIG. 2, in one embodiment, the blending unit 105 is connected to the chemical storage system 112, the proppant storage system 106, a water source 202, and a pumping grid 111 and may prepare a fracturing fluid, complete with proppant and chemical additives or modifiers, by mixing and blending fluids and chemicals at continuous rates according to the needs of a well formation. The blending unit 105 comprises a preblending unit 201 wherein water is fed from a water supply 202 and dry powder (guar) can be metered from a storage tank by way of a screw conveyor into the preblender's fluid stream where it is mixed with water and blended with various chemical additives and modifiers provided by the chemical storage system 112. These chemicals may include crosslinkers, gelling agents, viscosity altering chemicals, PH buffers, modifiers, surfactants, breakers, and stabilizers. This mixture is fed into the blending unit's hydration device, which provides a first-in-first-out laminar flow. This now near fully hydrated fluid stream is blended in the mixer 202 of the blending unit 105 with proppant from the proppant storage system to create the final fracturing fluid. This process can be accomplished at downhole pump rates. In one embodiment, the mixing apparatus is a modified Halliburton Growler mixer modified to blend proppant and chemical additives to the base fluid without destroying the base fluid properties but still providing ample energy for the blending of proppant into a near fully hydrated fracturing fluid. The final fluid can be directed to a pumping grid 111 and subsequently directed to a central manifold 107, which can connect and direct the fluid via connections 109, 204, or 205 to multiple wells 110 simultaneously.

Figure 3:
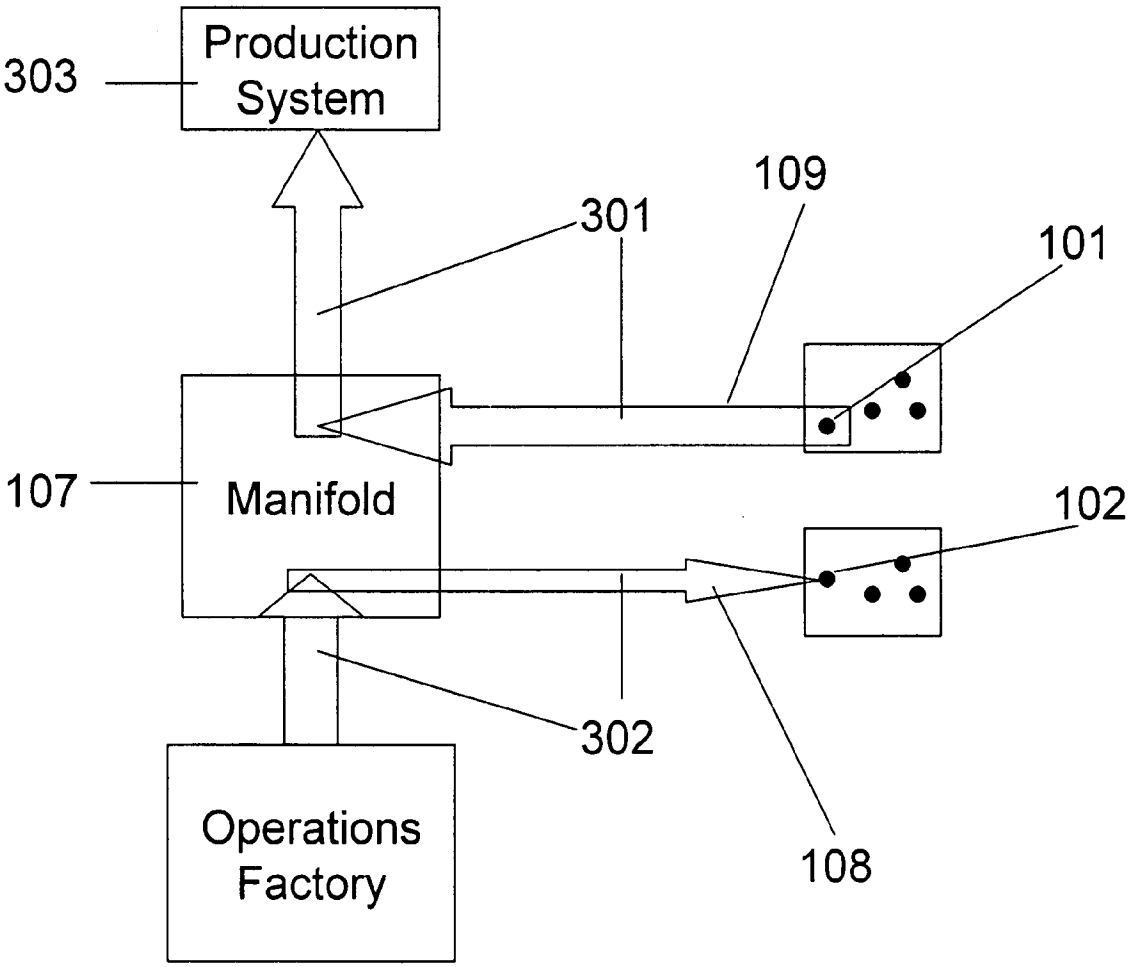
FIG. 3 is a flow diagram of central manifold used to treat wells and recover production fluid.

In one embodiment, the means for simultaneously flowing treatment fluid is a central manifold 107. The central manifold 107 is connected to the pumping grid 111 and is operable to flow stimulation fluid, for example, to multiple wells at different pads simultaneously. The stimulation fluid can comprise proppant, gelling agents, friction reducers, reactive fluid such as hydrochloric acid, and can be aqueous or hydrocarbon based. The manifold 107 is operable to treat simultaneously two separate wells, for example, as shown in FIG. 2 via connections 204 and 205. In this example, multiple wells can be fractured simultaneously, or a treatment fluid can be flowed simultaneously to multiple wells. The treatment fluid flowed can be of the same composition or different. These flows can be coordinated depending on a well's specific treatment needs. In addition, in reference to FIG. 3, the connection 109 between the central manifold 107 and a well location can be used in the opposite direction as shown in FIG. 2 to flow a production fluid, such as water or hydrocarbons, or return the well treatment fluid 301 from the well location to the manifold. From the central manifold 107, the production fluid can be directed to a production system 303 where it can be stored or processed or, in the case of the returning well treatment fluid, to a reclamation system that can allow components of returning fluid to be reused. The manifold is operable to receive production fluid or well treatment fluid from a first well location 101 while simultaneously flowing treatment fluid 302 using a second connection 108 to a second well location 102. The central manifold 107 is also operable to receive production fluid from both the first well location and the second well location simultaneously. In this embodiment, the first and second well locations can be at the same or different pads (as shown in FIG. 3). The manifold is also operable to extend multiple connections to a single well location. In reference to FIG. 2, in one embodiment, two connections are extended from the manifold to a single well location. One connection 109 may be used to deliver well treatment fluid to the well location while the other connection 203 may be used to deliver production fluid or return well treatment fluid from the well location to the central manifold 107.

Figure 4:
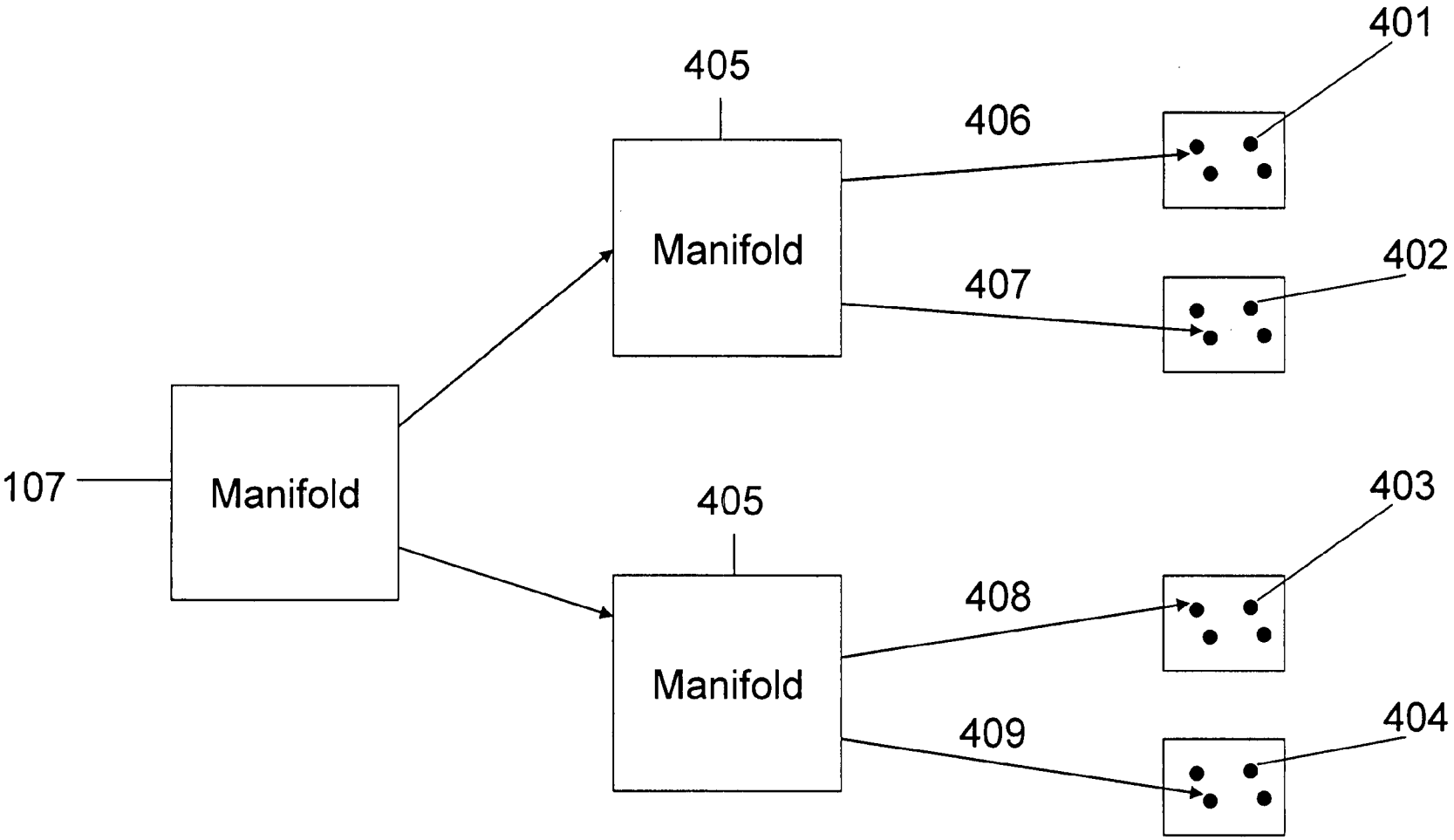
FIG. 4 is a diagram of a multiple manifold well treatment system.

In reference to FIG. 4, in one embodiment, the central manifold 107 can be connected to one or more additional manifolds 405. The additional manifolds are operable to connect to multiple well locations 401-404 and deliver well treatment fluids and receive production fluids via connections 406-409, respectively, in the same way as the central manifold 107 described above in reference to FIGS. 2 and 3. The additional manifolds can be located at the well pads.

Figure 5:
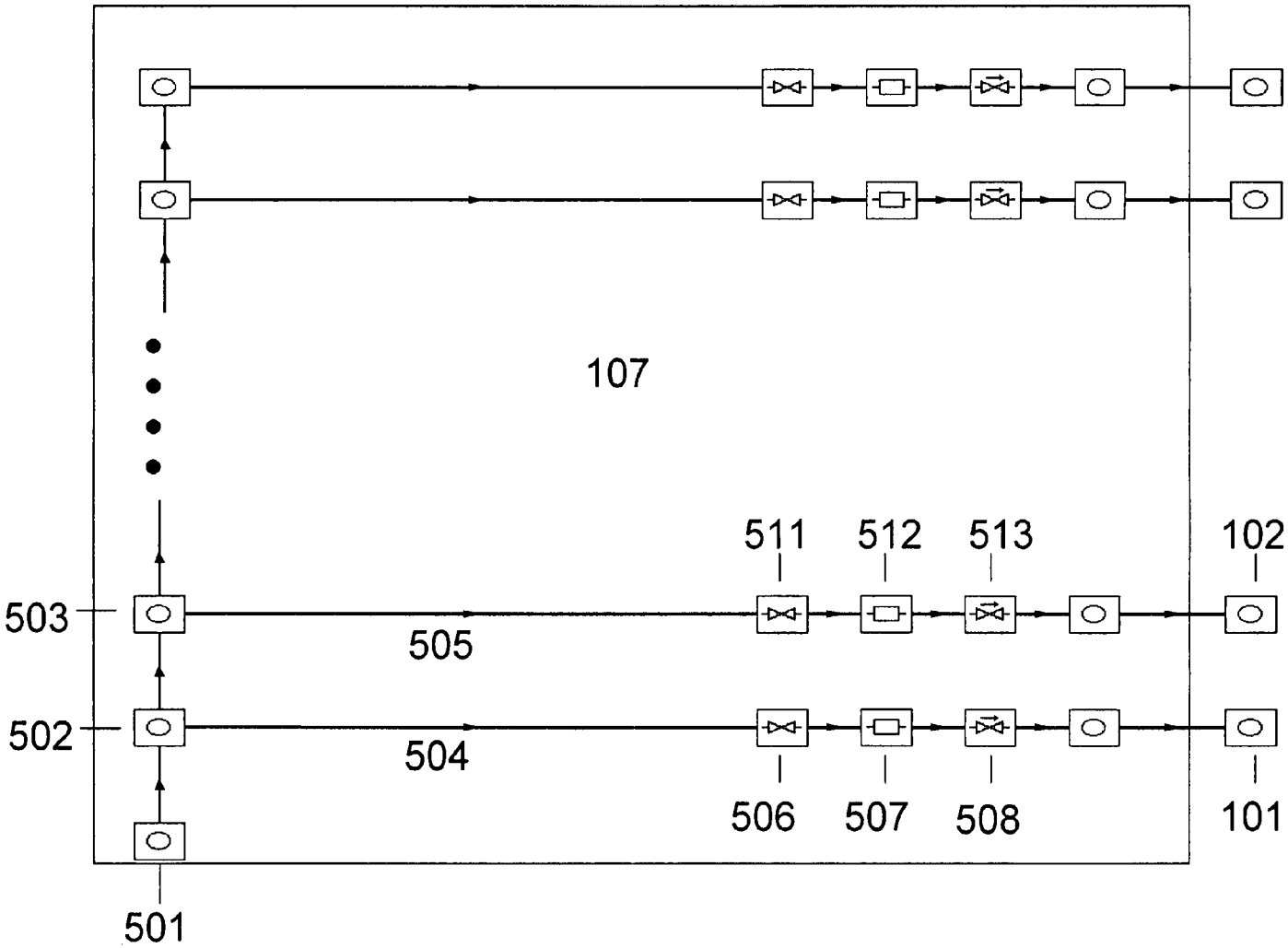
FIG. 5 is a schematic of a manifold apparatus for directing treatment fluid.

In reference to FIG. 5, in one embodiment, the central manifold has an input 501 that accepts pressurized stimulating fluid, fracturing fluid, or well treatment fluid from a pump truck or a pumping grid 111. The fluid flows into input 501 and through junctions 502 and 503 to lines 504 and 505. Line 504 contains a valve 506, a pressure sensor 507, and an additional valve 508. The line is connected to well head 101. Line 505 contains a valve 511, a pressure sensor 512, and an additional valve 513. These valves may be either plug valves or check valves and can be manually or electronically monitored and controlled. The pressure sensor may be a pressure transducer and may also be manually or electronically monitored or controlled. Line 504 is connected to well head 101 and line 505 is connected to well head 102. This configuration allows wells 101 and 102 to be stimulated individually and at a higher rate, by opening the valves along the line to the well to be treated while the valves along the other line are closed, or simultaneously at a lower rate, by opening the valves on both lines at the same time. As shown in FIG. 5, this architecture can be easily expanded to accommodate additional wells by the addition of junctions, lines, valves, and pressure sensors as illustrated. This architecture also allows monitoring the operations of the manifold and detecting leaks. By placing pressure sensors 507 and 512 between valves 506 and 508 and valves 511 and 513 respectively, the pressure of lines 504 and 505 can be readily determined during various phases of operation. For instance, when the manifold is configured to stimulate only well 101, valves 511 and 513 are closed. Pressure sensor 507 can detect the pressure within the active line 504, and pressure sensor 512 can be used to detect if there is any leakage, as it would be expected that the pressure in line 505 in this configuration would be minimal. In another embodiment, only a single valve is used along each of lines 504 and 505. This embodiment can be used to stimulate wells simultaneously or singly as well. Furthermore, as described in reference to FIG. 4, the manifold of this embodiment can also work in reverse and transfer fluid from the wellhead back through the manifold and to the central location. In this configuration, input 501 can be connected to a production system or reclamation system, for example, and the valves along the line connected to the wellhead in which it is desirable to recover fluid are open. The valves along the other lines may be open or closed depending on whether it is desirable to recover fluids from the wellheads connected to those lines. Production fluid or stimulation fluid can be returned from the wellhead to those systems respectively. This manifold can be located at the central location or at a remote pad.

Figure 6:
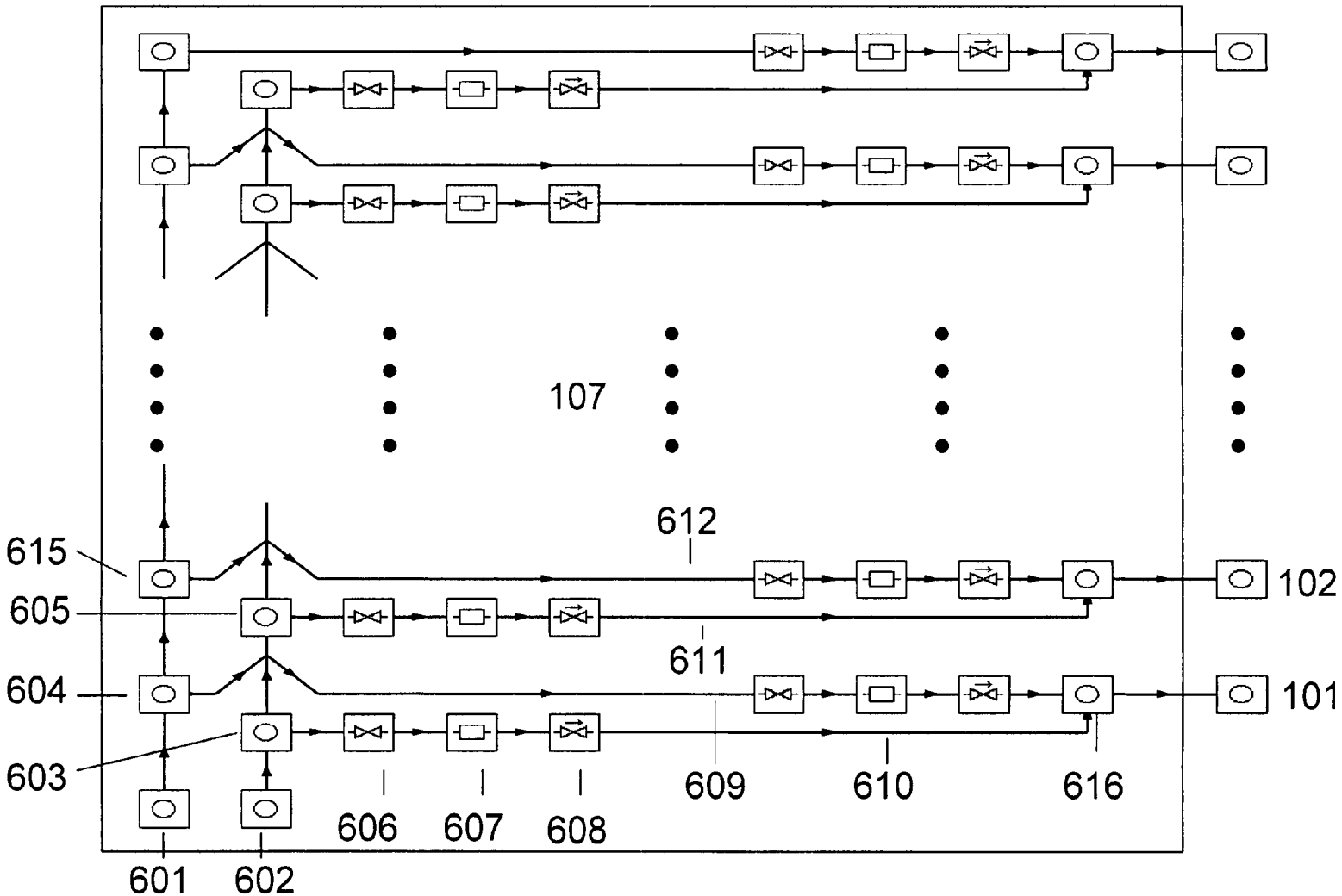
FIG. 6 is a schematic of a manifold apparatus for directing treatment fluid.

In reference to FIG. 6, in one embodiment, the central manifold contains two inputs 601 and 602 that accept pressurized stimulating fluid, fracturing fluid, or well treatment fluid from pump trucks or a pumping grid 111. Inputs 601 and 602 can accept fluid of different or the same compositions at similar or different pressures and rates. The fluid pumped through input 602 travels through junctions 603 and 605. The junctions are further connected to lines 610 and 611. The fluid pumped through input 601 travels through junctions 604 and 615. The junctions are further connected to lines 609 and 612. Lines 609, 610, 611, and 612 may each contain a valve 606, a pressure sensor 607, and an additional valve 608, or may contain only a single valve. These valves may be either plug valves or check valves and can be manually or electronically monitored and controlled. The pressure sensor may be a pressure transducer and may also be manually or electronically monitored or controlled. When, for example, the fluid from input 602 is desired to be delivered to well 101 only, the valves on line 610 are open and the valves on line 611 are closed. When the fluid from input 601 is desired to be delivered to well 101 only, the valves on line 609 are open and the valves on line 612 are closed. When it is desired that fluid from both inputs 601 and 602 are to be delivered to well 101 only, the valves on lines 609 and 610 are open and the valves on lines 611 and 612 are closed. Lines 609 and 610 are coupled to wellhead 101 through junction 616. When it is desired that fluid from input 602 be delivered to both wells 101 and 102 simultaneously, the valves on lines 610 and 611 are both open. Fluid from input 601 can be delivered to well 101 and fluid from input 602 can be delivered to well 102 simultaneously by closing the valves on lines 610 and 612 and opening the valves on lines 611 and 609. The delivery of fluid to well 102 works analogously. As shown in FIG. 6, the manifold can be easily expanded to include additional wells through additional junctions, lines, and valves. Furthermore, as described in reference to FIG. 4, the manifold of this embodiment can also work in reverse and transfer fluid from the wellhead back through the manifold and to the central location. In this configuration, either or both inputs 601 and 602 can be connected to a production system or reclamation system, for example, and the valves along the line connected to the wellhead in which it is desirable to recover fluid are open. The valves along the other lines may be open or closed depending on whether it is desirable to recover fluids from the wellheads connected to those lines. Production fluid or stimulation fluid can be returned from the wellhead to those systems respectively. This manifold can be located at the central location or at a remote pad.

Figure 7:
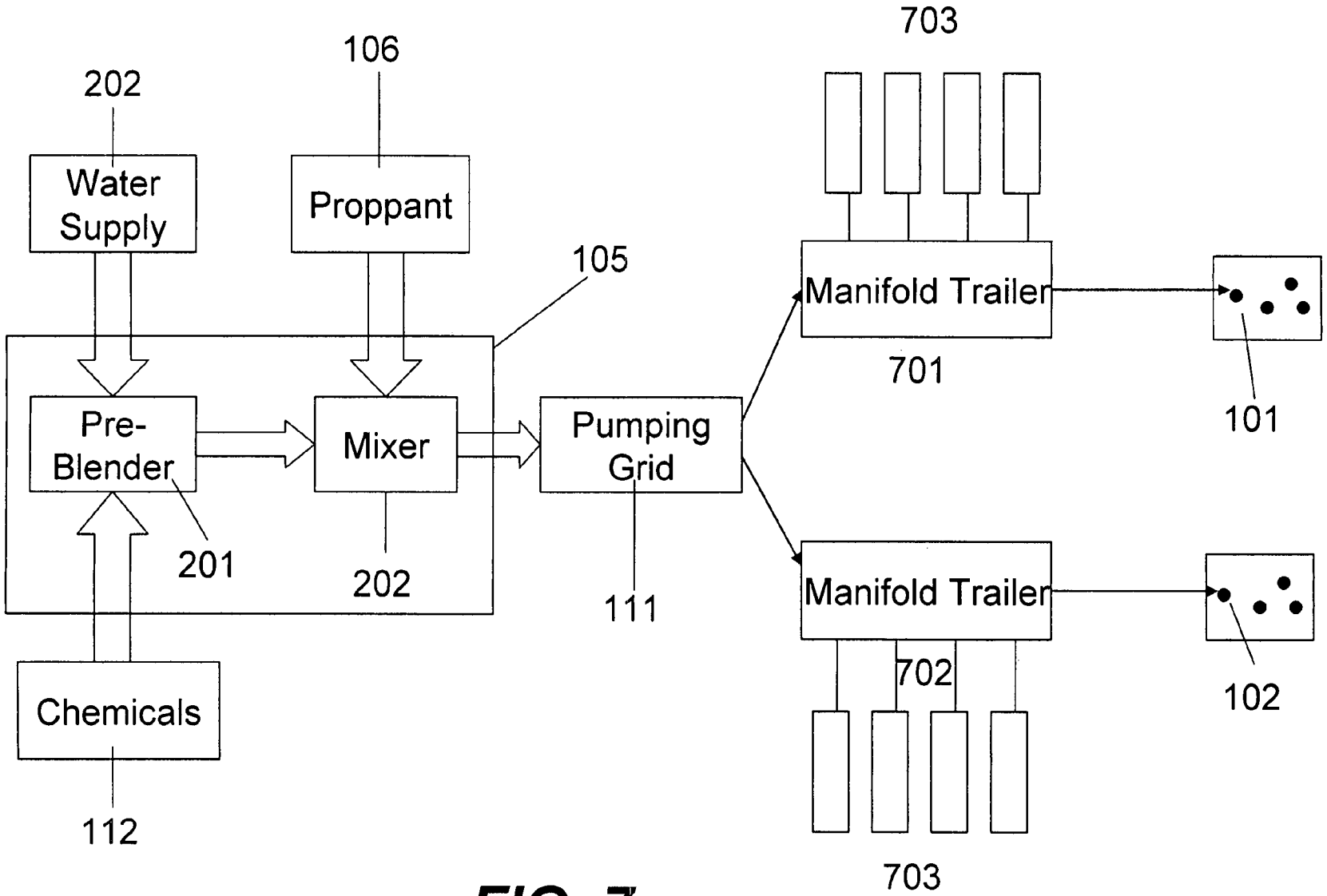
FIG. 7 is a schematic of a simultaneous fracturing method.

In reference to FIG. 7, in one embodiment, multiple manifold trailers 701 and 702 may be used at the central location where the stimulation fluid is manufactured and pressurized. The manifold trailers themselves are well known in the art. Each manifold trailer is connected to pressurized stimulating fluid through pump trucks 703 or a pumping grid 111. A line from each manifold trailer can connect directly to a well head to stimulate it directly, or it can further be connected to the manifolds described that are further connected to well locations.

In one embodiment of the pumping grid 111, the grid comprises one or more pumps that can be electric, gas, diesel, or natural gas powered. The grid can also contain spaces operable to receive equipment, such as pumps and other devices, modularized to fit within such spaces. The grid can be prewired and preplumbed and can contain lube oil and cooling capabilities. The grid is operable to accept connections to proppant storage and metering systems, chemical storage and metering systems, and blending units. The pumping grid can also have a crane that can assist in the replacement or movement of pumps, manifolds, or other equipment. A central manifold 107 can accept connections to wells and can be connected to the pumping grid. In one embodiment, the central manifold and pumping grid are operable to simultaneously treat both a first well head connected via a first connection and a second well head connected via a second connection with the stimulation fluid manufactured by the factory and connected to the pumping grid.

In some embodiments, the operations of the chemical storage system, proppant storage system, blending unit, pumping grid, power unit, and manifolds are controlled, coordinated, and monitored by a central control system. The central control system may use all of the sensor data from all units and the drive signals from their individual subcontrollers to determine subsystem trajectories. For example, control over the manufacture, pumping, gelling, blending, and resin coating of proppant by the control system can be driven by desired product properties such as density, rate, viscosity, etc. Control can also be driven by external factors affecting the subunits such as dynamic or steady-state bottlenecks. The central control system can include such features as: (1) virtual inertia, whereby the rates of the subsystems (chemical, proppant, power, etc.) are coupled despite differing individual responses; (2) backward capacitance control whereby the tub level controls cascade backward through the system; (3) volumetric observer whereby sand rate errors are decoupled and proportional ration control is allowed without steady-state error. The central control system can also be used to monitor equipment health and status.

The present invention can be used both for onshore and offshore operations using existing or specialized equipment or a combination of both. Such equipment can be modularized to expedite installation or replacement. The present invention may be enclosed in a permanent, semipermanent, or mobile structure.

As those of ordinary skill in the art will appreciate, the present invention can be adapted for multiple uses. By way of example only, multiple well sites may be treated, produced, or treated and produced sequentially or simultaneously from a single central location. The invention is capable of considerable additional modification, alteration, and equivalents in form and function, as will occur to those ordinarily skilled in the art having the benefit of this disclosure. The depicted and described embodiments of the invention are exemplary only, and are not exhaustive of the scope of the invention. Consequently, the invention is intended to be limited only by the spirit and scope of the appended claims.

What is claimed is:

1. A system for centralized well operations comprising:

a well treatment operations factory which manufactures and pumps a well stimulation fluid;

a first connection between a first well and the well operations factory;

a second connection between a second well and the well operations factory; and means for simultaneously flowing:

a first stimulation fluid to the first well and not to the second well; and a second stimulation fluid to the second well and not to the first well;

wherein the first stimulation fluid and the second stimulation fluid have different compositions.

2. The system of claim 1 wherein the means for simultaneously flowing treatment fluid comprises a manifold.

3. The system of claim 2 wherein the well operations factory comprises a pumping grid wherein the pumping grid is operable to connect to the manifold.

4. The system of claim 3 wherein the well operations factory comprises a blending unit wherein the blending unit is operable to connect to the pumping grid.

5. The system of claim 4 wherein the well operations factory comprises a proppant storage system wherein the proppant storage system is operable to deliver proppant to the blending unit.

6. The system of claim 5 wherein the well operations factory comprises a power unit operable to connect to the manifold, pumping grid, blending unit, the proppant storage system, the first well, and the second well.

7. The system of claim 6 wherein the well operations factory is enclosed in a structure selected from the group consisting of: a supported fabric structure, a collapsible structure, a prefabricated structure, a retractable structure, a composite structure, a temporary structure, a prefabricated wall and roof structure, a deployable structure, a modular structure, a preformed structure, a mobile accommodation structure, and combinations thereof.

8. The system of claim 4 wherein the well operations factory comprises a chemical storage system wherein the chemical storage system is operable to connect to the blending unit.

9. The system of claim 8 wherein the well operations factory comprises a power unit operable to connect to the manifold, pumping grid, blending unit, chemical storage system, the first well, and the second well.

10. The system of claim 2 wherein the first connection is operable to deliver a fluid from the first well to the manifold.

11. The system of claim 10 wherein the fluid comprises a stimulation fluid.

12. The system of claim 2 wherein the second connection is operable to deliver a fluid from the second well to the manifold.

13. The system of claim 12 wherein the fluid comprises a stimulation fluid.

14. The system of claim 2 wherein the manifold is connected to a second manifold.

15. The system of claim 14 wherein the second manifold is operable to simultaneously flow a first stimulation fluid to the first well and a second stimulation fluid to the second well.

16. The system of claim 2 comprising a third connection between the manifold and the first well.

17. The system of claim 16 wherein the third connection is operable to deliver a fluid from the first well to the manifold.

18. The system of claim 17 comprising a fourth connection between the manifold and the second well.

19. The system of claim 18 wherein the fourth connection is operable to deliver a fluid from the second well to the manifold.

20. The system of claim 1 wherein the well operations factory and means for simultaneously flowing treatment fluid are located on a boat.

21. The system of claim 1 wherein the first fluid comprises at least one compound selected from the group consisting of: a proppant, a fracturing fluid, a gelling agent, a friction reducer, an acid, and a derivative thereof.

22. The system of claim 1 wherein the second stimulation fluid comprises at least one compound selected from the group consisting of: a proppant, a fracturing fluid, a gelling agent, a friction reducer, an acid, and a derivative thereof.

23. The system of claim 1, wherein the wells are on separate pads and wherein the well treatment operations factory dynamically manufactures and pumps a well stimulation fluid.

24. A system for centralized well operations comprising:

a well treatment operations factory which manufactures and pumps a well stimulation fluid;

a first connection between a first pad and the well operations factory, wherein the first pad has a first well;

a second connection between a second pad and the well operations factory, wherein the second pad has a second well; and means for simultaneously flowing:

a first stimulation fluid to the first pad and not to the second pad; and a second stimulation fluid to the second pad and not to the first pad;

wherein the first stimulation fluid and the second stimulation fluid have different compositions.

25. A system for centralized well operations comprising:

a well treatment operations factory which dynamically manufactures and pumps a well stimulation fluid;

a first connection between a first well and the well operations factory;

a second connection between a second well and the well operations factory; and means for simultaneously flowing:

a first stimulation fluid to the first well and not to the second well; and a second stimulation fluid to the second well and not to the first well;

wherein the first stimulation fluid and the second stimulation fluid have different compositions.

26. A system for centralized well operations comprising:

a well treatment operations factory which manufactures and pumps a well stimulation fluid;

a first connection between a first plurality of wells and the well operations factory;

a second connection between a second plurality of wells and the well operations factory; and means for simultaneously flowing:

a first stimulation fluid to the first plurality of wells and not to the second plurality of wells; and a second stimulation fluid to the second plurality of wells and not to the first plurality of wells;

wherein the first stimulation fluid and the second stimulation fluid have different compositions.

27. A system for centralized well operations comprising:

a well treatment operations factory capable of manufacturing and simultaneously pumping a plurality of well stimulation fluids;

a first connection between a first well and the well operations factory;

a second connection between a second well and the well operations factory; and means for simultaneously flowing:

a first stimulation fluid to the first well and not to the second well; and a second stimulation fluid to the second well and not to the first well.

* * * * *